United States Patent [19]

Neitz et al.

[11] 4,274,371

[45] Jun. 23, 1981

[54] APPARATUS FOR PREHEATING THE INTAKE AIR FOR AIR-COMPRESSING INTERNAL COMBUSTION ENGINES

[75] Inventors: Alfred Neitz, Röthenbach; Nunzio D'Alfonso, Nuremberg, both of Fed. Rep. of Germany

[73] Assignee: Maschinenfabrik Augsburg-Nürnberg Aktiengesellschaft, Nuremberg, Fed. Rep. of Germany

[21] Appl. No.: 945,634

[22] Filed: Sep. 25, 1978

[30] Foreign Application Priority Data

Sep. 24, 1977 [DE] Fed. Rep. of Germany ..... 2743134

[51] Int. Cl.[3] ..... F02N 17/00

[52] U.S. Cl. ..... 123/179 H; 123/179 G

[58] Field of Search ..... 123/179 H, 122 G, 179 G, 123/179 R, 139 ST; 239/124, 126, 127

[56] References Cited

U.S. PATENT DOCUMENTS

| | | | |
|---|---|---|---|
| 3,353,520 | 11/1967 | Haag | 123/179 H |
| 3,379,184 | 4/1968 | Wolf | 123/179 H |
| 3,547,093 | 12/1970 | Sherman | 123/179 H |
| 3,977,376 | 8/1976 | Reid et al. | 123/179 H |
| 4,157,084 | 6/1979 | Wallis | 123/179 G |

FOREIGN PATENT DOCUMENTS

| | | | |
|---|---|---|---|
| 2743134 | 5/1979 | Fed. Rep. of Germany | 123/179 H |

*Primary Examiner*—P. S. Lall

*Attorney, Agent, or Firm*—Becker & Becker, Inc.

[57] ABSTRACT

A fuel delivery system provided with at least a fuel delivery pump and a high pressure pump distributing fuel to individual injectors on the cylinders included with apparatus for preheating the intake air for air-compressing internal combustion engines. Communication therewith occurs through a header pipe. Components thereof include an injection valve provided at the end of all high pressure pipes leading to the engine cylinders and arranged to open at a predetermined pressure. Each of the high pressure pipes is provided with a branch off conduit arranged to be shut off by an isolating valve. All branch offs are brought together to a common header pipe supplying the preheating equipment with fuel.

3 Claims, 2 Drawing Figures

APPARATUS FOR PREHEATING THE INTAKE AIR FOR AIR-COMPRESSING INTERNAL COMBUSTION ENGINES

This invention relates to apparatus for the preheating of the intake air for air-compressing internal combustion engines having a fuel delivery system including at least a fuel delivery pump and a high-pressure injection pump distributing the fuel to the individual injectors on the cylinders and communicating through a header pipe with the fuel delivery system and having at least one injector and an ignition system.

Apparatus exists and has been sufficiently disclosed in many variations for preheating the intake air arranged in the intake system of the internal combustion engine and serving primarily as starting aids, especially when the engine is cold. Generally, such apparatus includes a glow element along which the intake air is made to flow to be heated in the process; alternately, such apparatus includes a spark plug and a fuel injector or a burner in which a proportion of the intake air is utilized for the combustion of the injected fuel, the burnt gases being then mixed with the remainder of the fresh air to heat the air and eventually to enter the cylinders together therewith.

In the latter preheating systems, the fuel is delivered to the burner either by a separate pump or by the fuel delivery pump provided in the fuel system (See German Auslegeschrift No. 1,576,017) being employed for this purpose with the header pipe leading to the burner being branched off immediately downstream of the fuel delivery pump. A valve, preferably of the solenoid type, enables the burner or rather the fuel supply to the burner to be cut in and cut out. A basically similar layout was also disclosed by the German Offenlegungsschrift No. 2,139,412.

In order to bring the engine as quickly as possible to the temperature level necessary for starting, it is desirable for a hot gas generator to be used in the intake system whereby a maximum percentage of the intake air is used for the combustion of a proportionate fuel amount and is heated as a result. However, with almost all intake air being utilized for combustion in the intake system, the consequence is that the cylinders during the preheating will be filled with burnt gases so that starting of the engine during this period is not possible or occurs only with difficulty. For this reason, it has been suggested that the starting cycle be divided into two phases, namely, into "preheating" and, subsequently, "start of spontaneous running of the engine." This permits the starting period to be substantially reduced with an additional reduction being possible if, by appropriately changing the valve actuation during the preheating period, the engine is made to operate as an air pump in the two-stroke cycle instead of in the four-stroke cycle because this will cause double the amount of air to be delivered through the cylinders.

The hot gas generators are generally based on the use of an injector nozzle, the aim being to achieve fast mixing of the fuel with the air which is possible only by fine atomization of the fuel. Fine atomization, in turn, is preconditioned and dependent upon the existence of a high injection pressure which cannot be obtained by means of the fuel delivery pump.

Furthermore, metering the amount of fuel to be injected into the burner presents difficulties with continuous fuel supply. Such difficulties occur especially where small amounts of fuel are involved such as are necessary for engines with a low air throughput. Difficulties occur because the lower limit of fuel throughput is dictated by the minimum pressure needed for effective atomization and the minimum diameter of the injector nozzle hole permitted by production tooling.

This is the starting point of the present invention which has for its object to improve preheating apparatus of the type initially described for internal combustion engines in a manner such that a maximum pressure exists at the injector of the burner during the preheating phase whereby sufficient atomization of the fuel and, consequently, mixing with the intake air are ensured and that the fuel supply can be metered.

According to the present invention, this object is achieved in that an injection valve is provided at the end of each high pressure pipe leading to the engine cylinders. The injection valve will open at a preset pressure and high pressure pipes are provided with a branch-off conduit means capable of being closed by a shut-off valve. All branch-offs are brought together to a common header pipe supplying the preheating apparatus with fuel.

This arrangement provides for the header pipe leading to the preheating apparatus being fed directly from the high pressure injection pump during the preheating cycle of the engine being cranked by means of the starter through the branch-offs and the high pressure pipe leading to the injection valves. The throttling effects of the injection nozzle in the preheating apparatus and/or the opening pressure of an injection valve installed there is so adjusted that the maximum pressure in the header pipe will not exceed the opening pressure of the cylinder injectors. When the engine is cranked, all high-pressure pipes to the cylinder injectors will initially be isolated by means of the initial forces imposed by the injector springs. The header pipes are supplied with fuel in sequence and intermittently by all pump elements. On completion of the preheating cycle, the branch-offs are isolated automatically as the function of the temperature of the critical engine components or other parameters. The pressure in the high pressure pipes to the cylinder injectors will again reach the level necessary for the opening of the cylinder injectors; the fuel supply to the individual cylinders is released so that the second phase, i.e. starting of spontaneous running, can be initiated.

The adjustment of the fuel quantity and any necessary adaptation thereof to the decreasing air flow during the preheating as the temperature rises are effected by the governor element existing in the high pressure injection pump, representing another advantage.

As a further feature of the invention, it is proposed that, after completing the preheating, fuel delivery by the high pressure injection pump is temporarily stopped completely by means of the existing shut-off device so that the engine carries out some revolutions to completely expel the burnt gases from the cylinders before starting is initiated.

Furthermore, it is proposed according to the invention to install a change-over valve in the header pipe which will connect the header pipe automatically to a leakage oil pipe on completion of the preheating phase for draining and depressurizing.

The invention can be realized in a very simple manner in a distributor type injector pump where all high pressure pipes leading from the cylinders to the injectors are capable of being supplied with fuel and are capable of being shut off again individually in sequence by a rotary and slidable pumping and distributor piston movably arranged in the injection pump. In this case, the branch-offs are inherently formed by the pressure space in the high pressure injection pump so that all that is needed is to connect the header pipe for the preheating apparatus with said pressure space. The shut-off elements isolating the individual branch-offs are replaced by a single shut-off valve in the header pipe which may take the form of a multi-way valve and, after connection, will connect the header pipe to the leakage oil pipe.

For further details of the invention, reference is made to the single view of the drawing and the description of a typical embodiment of the invention which is shown schematically. The single view of the drawing shows part of a distributor type injector pump sectioned with the injector nozzle belonging to the preheating apparatus being arranged in the intake system.

IN THE DRAWINGS

Figure 1:
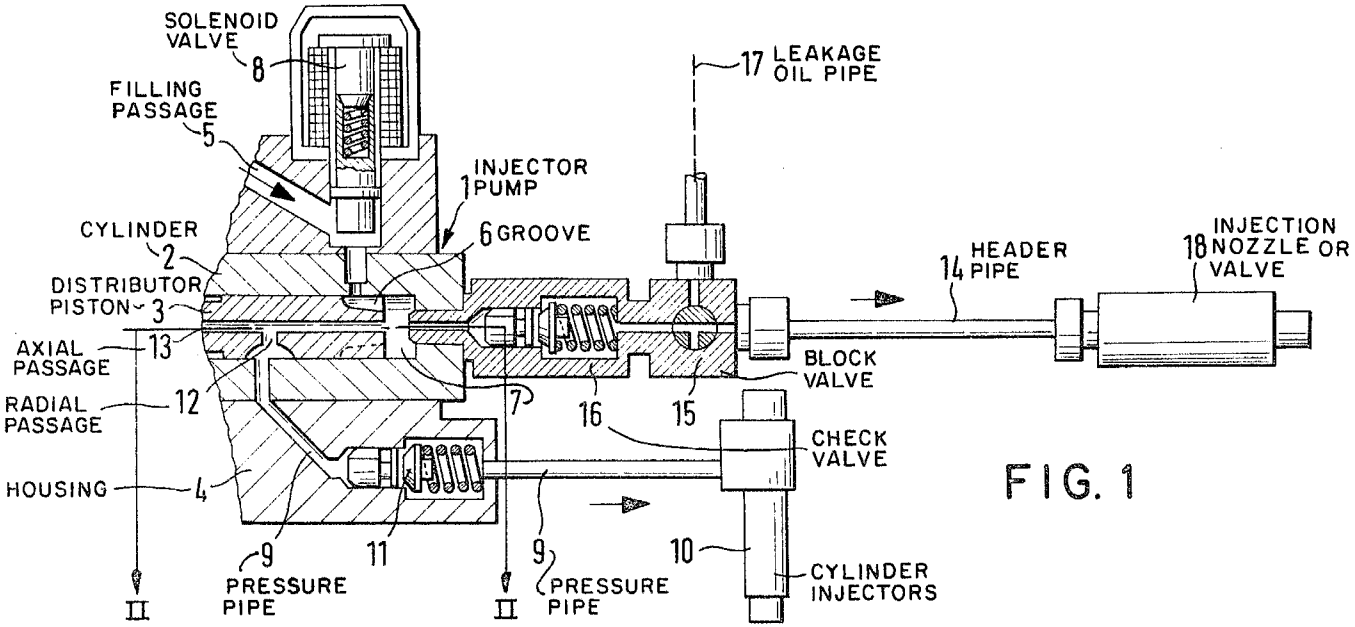
FIG. 1 is a partially sectioned elevational view of a part of an injection pump having an injector nozzle belonging to a preheating apparatus arranged in the intake system thereof.
Figure 2:
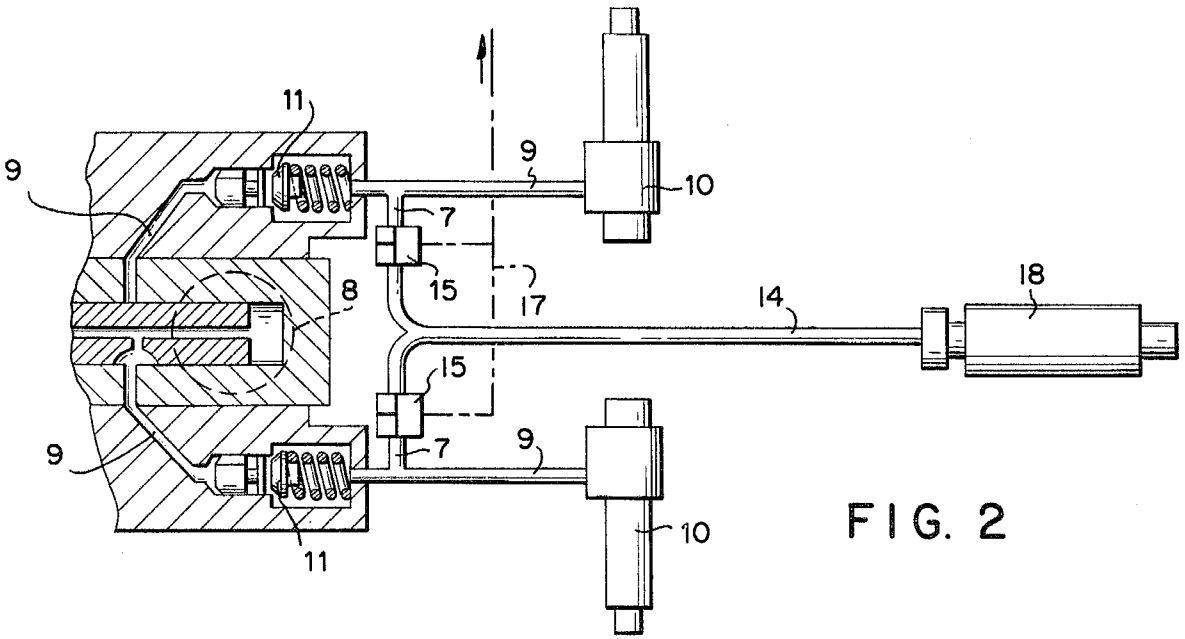
FIG. 2 is a cross section taken along line II—II in FIG. 1.

The distributor type injector pump 1 essentially consists of a cylinder 2 in which a distributor piston 3 is arranged rotatably and slidably movable therein, and a housing 4 enclosing the cylinder 2 and solidly connected therewith. A filling passage 5 is provided in the housing 4. The fuel flows through the passage 5 from the fuel delivery pump, which is not shown in the drawing via groove 6 machined into the distributor piston 3 into the pressure space 7 of the distributor type injection pump 1. The filling passage 5 is capable of being shut off by an automatically operated solenoid valve 8. The housing 4 has a high-pressure pipe 9 for each cylinder of the engine arranged around the cylinder 2. Each high pressure pipe 9 extends to a cylinder injector 10. Each injector 10 is provided with a check valve 11 embodied as an unloading or relief valve. A radial passage 12 and an axial passage 13 provided in the distributor piston 3 permit a high pressure pipe 9 to be connected to the pressure space 7 whereby fuel is admitted to the associated cylinder injector 10. From the pressure space 7, a header pipe 14 leads directly to the injection nozzle or injection valve 18 of the preheating apparatus arranged in the intake system of the engine. Installed in the header pipe are an isolating (blocking-off) or change-over valve 15, as well as a rebound or check valve 16 designed as an unloading or relief valve. Finally, a leakage oil pipe 17 may be provided to return fuel from the change-over valve 15 to the fuel tank.

During the starting of the engine, it will be driven by the battery-fed starter; the fuel delivery pump will supply fuel to the distributor type injection pipe 1 through the open filling passage 5; the fuel flows through the grooves 6 into the pressure space 7 to be discharged by the reciprocating distributor piston 3. The change-over valve 15 will be fully opened, permitting the fuel to pass through the header pipe 14 to the injection nozzle or injection valve 18 in the preheating apparatus where it will be finally atomized and mixed with the intake air, the combustible mixture being ignited by a high-voltage ignition system. The cylinder injectors 10 are set so that they will not open in any event as long as the preheating apparatus is in operation. When the air carrying engine components have reached a temperature sufficient for ignition, the fuel supply to the injection nozzle 18 through the change-over valve 15 which is under temperature-dependent control will be stopped. The solenoid valve 8 will simultaneously close the filling passage 5, whereby the engine will perform some working cycles without fuel being admitted until burnt gases introduced into the engine cylinder by the preheating apparatus have been expelled. Then the solenoid (magnet) valve 8 will open again with the fuel being delivered from the pressure space 7 which is now closed; fuel is delivered through the distributor piston by way of the longitudinal passage 13, the radial passage 12, the pressure pipe 9 communicating with the latter depending on the rotary position of the distributor piston 3, and the integrated unloading or relief valve 11 to the injector 10 so that fuel injection into the individual cylinders will occur in sequence. Simultaneously, the engine will be started automatically in the spontaneous mode of operation.

It should be emphasized that, for the sake of a better understanding, the invention has been described on the basis of one of the simplest injection pumps where, in particular, there is no need for branch off conduits from the high pressure pipes 9.

It is of course, to be understood that the present invention is, by no means, limited to the specific showing in the drawing, but also comprises any modification within the scope of the appended claims.

What we claim is:

1. An apparatus for preheating intake air passing through high pressure pipes leading to cylinders of air-compressing internal combustion engines with a fuel delivery having at least a fuel delivery pump and a high pressure injection pump distributing the fuel to individual injectors on the cylinders, the apparatus communicating through a header pipe means with the fuel delivery system and comprising in combination at least one injection nozzle and an ignition system, injection valve means provided at one end of all high pressure pipes leading to the engine cylinders and arranged to open at a predetermined pressure, a branch-off means provided with each of the high pressure pipes, and an isolating change-over valve means provided to shut-off said branch-off means, all of said branch-off means being brought together to common header pipe means supplying the preheating equipment with fuel under high pressure all branch-off means being arranged to be individually and in series connectable to the header pipe means as the engine is cranked to supply the preheating apparatus intermittently with fuel subject to a high pressure, said injection valve means at the end of the high pressure pipes releasing fuel admission to individual cylinders only when all of said branch-off means remain closed, a leakage oil pipe connectable by said change-over valve means to said header pipe means when all branch-off means are closed, and a distributor piston rotatably and slidably movable in the high pressure injection pump so that all high pressure pipes are capable of being individually supplied with fuel and isolated again, the branch-off means being formed directly by a pressure space portion in the high pressure injection pump, said header pipe means communicating directly with said pressure space portion, said isolating change-over valve means shutting-off the branch-off means being formed as an isolating change-over valve in said header pipe means.

2. An apparatus in combination according to claim 1, in which shut-off valve means and filling passage means are arranged to permit temporary closing of said filling passage means by said shut-off valve means when all branch-off means are closed and the preheating apparatus is inoperative.

3. An apparatus in combination according to claim 1, in which said isolating change-over valve means provided in said header pipe means is an automatic change-over valve through which the preheating apparatus is connected to said leakage oil pipe after the preheating apparatus has been shut down.

* * * * *